US011680741B2

(12) United States Patent
Li et al.

(10) Patent No.: US 11,680,741 B2
(45) Date of Patent: Jun. 20, 2023

(54) REFRIGERATOR HAVING TRANSMISSION ASSEMBLY

(71) Applicant: HISENSE RONSHEN (GUANGDONG) REFRIGERATOR CO., LTD., Guangdong (CN)

(72) Inventors: Zhipeng Li, Guangdong (CN); Yong Zeng, Guangdong (CN); Zehong Xu, Guangdong (CN)

(73) Assignee: HISENSE RONSHEN (GUANGDONG) REFRIGERATOR CO., LTD., Guangdong (CN)

( * ) Notice: Subject to any disclaimer, the term of this patent is extended or adjusted under 35 U.S.C. 154(b) by 622 days.

(21) Appl. No.: 16/743,871

(22) Filed: Jan. 15, 2020

(65) Prior Publication Data

US 2020/0149796 A1 May 14, 2020

Related U.S. Application Data

(63) Continuation of application No. 15/633,498, filed on Jun. 26, 2017, now Pat. No. 10,571,182, which is a (Continued)

(30) Foreign Application Priority Data

Dec. 31, 2015 (CN) ..... 201511034383.5
Dec. 31, 2015 (CN) ..... 201511034935.2

(51) Int. Cl.
*F25C 5/04* (2006.01)
*F25C 5/20* (2018.01)

(52) U.S. Cl.
CPC ..... *F25C 5/046* (2013.01); *F25C 5/22* (2018.01); *F25C 2400/08* (2013.01); *F25C 2400/10* (2013.01); *F25C 2500/08* (2013.01)

(58) Field of Classification Search
CPC ..... F25C 5/046; F25C 5/22; F25C 2400/08; F25C 2500/08; F25C 2400/10
See application file for complete search history.

(56) References Cited

U.S. PATENT DOCUMENTS 2,174,461 A 9/1939 Fegley et al.
2,195,363 A 3/1940 Fegley et al.
(Continued)

FOREIGN PATENT DOCUMENTS

CN 1837720 A 9/2006
CN 101529174 B 9/2009
(Continued)

OTHER PUBLICATIONS

JP-2003269833-A (Year: 2003).*
(Continued)

*Primary Examiner* — Jonathan Bradford
(74) *Attorney, Agent, or Firm* — MH2 Technology Law Group LLP

(57) ABSTRACT

A refrigerator includes a refrigerator door and an ice maker. The ice maker includes an ice storage container disposed on the refrigerator door, a stirrer provided in the ice storage container and an ice knife assembly provided in the ice storage container. The stirrer includes a rotary shaft and the rotary shaft of the stirrer is in a first fixed position relative to the ice storage container. The ice knife assembly includes a rotary shaft and the rotary shaft of the ice knife assembly is in a second fixed position relative to the ice storage container. The rotary shaft of the stirrer is located above the rotary shaft of the ice knife assembly, and an orthographic projection of the rotary shaft of the stirrer in a horizontal plane is perpendicular to that of the rotary shaft of the ice knife assembly in the same horizontal plane.

11 Claims, 8 Drawing Sheets

Related U.S. Application Data continuation of application No. PCT/CN2016/074062, filed on Feb. 18, 2016.

(56) References Cited

U.S. PATENT DOCUMENTS

| | | | | |
|---|---|---|---|---|
| 2,208,040 | A | 7/1940 | Moeller | |
| 2,213,166 | A | 8/1940 | Majewski, Jr. | |
| 2,588,741 | A | 3/1952 | Matthiesen | |
| 3,268,118 | A * | 8/1966 | Hoenisch | B67D 1/16 62/320 |
| 3,809,295 | A * | 5/1974 | Vitencz | F25C 5/20 366/325.2 |
| 4,176,527 | A | 12/1979 | Linstromberg et al. | |
| 4,450,692 | A * | 5/1984 | Sharpe | A23G 9/12 62/342 |
| 4,817,735 | A | 4/1989 | Corrigan | |
| 4,942,983 | A * | 7/1990 | Bradbury | F25C 5/24 222/413 |
| 5,054,654 | A * | 10/1991 | Schroeder | F25C 5/20 222/239 |
| 5,212,955 | A | 5/1993 | Hogan | |
| 5,246,288 | A * | 9/1993 | Jetzer | B01F 27/50 366/279 |
| 5,910,164 | A * | 6/1999 | Snelling | A23G 9/28 62/344 |
| 6,442,954 | B1 * | 9/2002 | Shapiro | F25C 5/22 62/344 |
| 6,607,150 | B1 | 8/2003 | Izutsu et al. | |
| 8,746,002 | B2 | 6/2014 | Lee et al. | |
| RE46,794 | E | 4/2018 | Lee et al. | |
| 2001/0027654 | A1 * | 10/2001 | Shapiro | F25C 1/10 62/1 |
| 2004/0032173 | A1 * | 2/2004 | Tsergas | F16H 1/203 310/83 |
| 2005/0072166 | A1 | 4/2005 | Lee et al. | |
| 2006/0055258 | A1 * | 3/2006 | Tsergas | F16H 57/038 74/606 R |
| 2006/0156526 | A1 * | 7/2006 | Tobler | F25C 5/24 29/412 |
| 2006/0168984 | A1 | 8/2006 | Myers | |
| 2006/0213213 | A1 * | 9/2006 | Chung | F25C 5/046 62/344 |
| 2006/0248911 | A1 | 11/2006 | An et al. | |
| 2008/0156826 | A1 | 7/2008 | Kim et al. | |
| 2009/0165492 | A1 * | 7/2009 | Wilson | F25C 1/10 62/344 |
| 2010/0126203 | A1 | 5/2010 | Kim et al. | |
| 2010/0251740 | A1 | 10/2010 | Schmidt et al. | |
| 2010/0313593 | A1 | 12/2010 | Lee et al. | |
| 2011/0067429 | A1 | 3/2011 | Lee et al. | |
| 2013/0092707 | A1 | 4/2013 | Kim et al. | |
| 2013/0327076 | A1 * | 12/2013 | Jeong | F25C 5/046 62/344 |
| 2015/0176882 | A1 * | 6/2015 | Jeong | F25D 23/028 62/344 |
| 2016/0216021 | A1 * | 7/2016 | Kang | F25C 5/22 |
| 2021/0310714 | A1 * | 10/2021 | Olvera | F25C 5/22 |

FOREIGN PATENT DOCUMENTS

| | | | | |
|---|---|---|---|---|
| CN | 101839611 | A | 9/2010 | |
| CN | 102278843 | A | 12/2011 | |
| CN | 103047804 | A | 4/2013 | |
| CN | 103115471 | A | 5/2013 | |
| CN | 103575011 | A | 2/2014 | |
| CN | 103575012 | A | 2/2014 | |
| CN | 103925757 | A | 7/2014 | |
| CN | 204100680 | U | 1/2015 | |
| CN | 204693916 | U | 10/2015 | |
| CN | 105423672 | A | 3/2016 | |
| CN | 105444484 | A | 3/2016 | |
| DE | 10 2007 048 573 | A1 | 4/2009 | |
| EP | 2886979 | A2 * | 6/2015 | F25C 5/18 |
| JP | H1-273976 | | 11/1989 | |
| JP | H 11-257813 | A | 9/1999 | |
| KR | 10 0540792 | | 10/2004 | |
| KR | 10-2005-0082829 | A | 8/2005 | |
| KR | 10-2005-0114443 | A | 12/2005 | |
| KR | 10-2007-0079735 | A | 8/2007 | |
| WO | WO-9609981 | A1 * | 4/1996 | B67D 1/0857 |
| WO | WO 2008/054161 | A2 | 5/2008 | |

OTHER PUBLICATIONS

First Office Action dated Jan. 19, 2020 for corresponding Chinese application No. 201810524347.4, 5 pages, in Chinese language.

English language translation of First Office Action dated Jan. 19, 2020 for corresponding Chinese application No. 201810524347.4, 5 pages.

First Office Action dated Jun. 30, 2017 from corresponding Chinese Application 201511034383.5 (7 page English translation).

Non-Final Office Action dated Apr. 8, 2019 (25 pages) from U.S. priority U.S. Appl. No. 15/633,498, filed Jun. 26, 2017.

First Office Action dated Aug. 3, 2017 (10 pages) from corresponding Chinese Application No. 201511034935.2.

Second Office Action dated Jan. 17, 2018 (6 pages including English translation) from corresponding Chinese Application 201511034383.5.

Third Office Action dated Jan. 4, 2019 (13 pages including English translation) from corresponding Chinese Application 201511034383.5.

Extended European Search Report (8 pages) dated Jul. 18, 2019 from corresponding European Application No. 16876947.9.

International Search Report of PCT application PCT/CN2016/074062 dated Oct. 14, 2016, 12 pages.

* cited by examiner

REFRIGERATOR HAVING TRANSMISSION ASSEMBLY

CROSS-REFERENCE TO RELATED APPLICATIONS

This application is a Continuation Application of the U.S. patent application Ser. No. 15/633,498, filed on Jun. 26, 2017, which is a bypass continuation of PCT/CN2016/074062, filed on Feb. 18, 2016, which claims the priority of Chinese Patent Application No. 201511034383.5, filed on Dec. 31, 2015 and Chinese Patent Application No. 201511034935.2, filed on Dec. 31, 2015, all of which are incorporated herein by reference in their entireties.

FIELD OF TECHNOLOGY

The present disclosure relates to a refrigerator.

BACKGROUND

With the continuous development of science and technology and the continuous improvement of people's living standards, in order to meet people's higher and higher requirements for living quality, the function of household appliances also keeps increasing, such as adding an ice maker to a refrigerator and so on. The ice maker comprises an ice making device and an ice crushing device. After ice cubes are prepared by the ice making device, the ice cubes are stored in a barrel-shaped container so that users can access them. Meanwhile, those skilled in the art set the ice discharging forms of the refrigerator as the mode of crushed ice and the mode of ice cubes for convenient use. In the mode of crushed ice, users access the crushed ice cubes; while in the mode of ice cubes, users access the complete ice cubes. However, after the ice cubes are stored in the barrel-shaped container, the ice cubes in contact with each other for a long time prone to freeze together, and even all the ice cubes in the whole barrel-shaped container may freeze together. In order to solve this problem, those skilled in the art adopt setting a stirring structure in the barrel-shaped container so as to make the ice cubes move within the barrel-shaped container, thus solving the problem that the ice cubes in contact with each other for a long time freeze together.

SUMMARY

Some embodiments of the disclosure provide a refrigerator. The refrigerator comprises a refrigerator door and an ice maker. The ice maker comprises: an ice storage container disposed on the refrigerator door; a stirrer provided in the ice storage container, wherein the stirrer comprises a rotary shaft and the rotary shaft of the stirrer is in a first fixed position relative to the ice storage container; and an ice knife assembly provided in the ice storage container, wherein the ice knife assembly comprises a rotary shaft and the rotary shaft of the ice knife assembly is in a second fixed position relative to the ice storage container; wherein the rotary shaft of the stirrer is located above the rotary shaft of the ice knife assembly, and an orthographic projection of the rotary shaft of the stirrer in a horizontal plane is perpendicular to that of the rotary shaft of the ice knife assembly in the same horizontal plane.

BRIEF DESCRIPTION OF THE DRAWINGS

In order to describe technical solutions in the embodiments of the present disclosure or in the prior art more clearly, the accompanying drawings to be used for describing the embodiments or the prior art will be introduced briefly. Obviously, the accompanying drawings to be described below are merely some embodiments of the present disclosure, and an ordinary person skilled in the art can obtain other drawings according to those drawings without paying any creative effort.

DETAILED DESCRIPTION OF THE EMBODIMENTS

The technical solutions in the embodiments of the present disclosure will be described below clearly and completely with reference to the accompanying drawings in the embodiments of the present disclosure. Obviously, the embodiments to be described are merely some but not all of embodiments of the present disclosure. Based on the embodiments of the present disclosure, all other embodiments obtained by an ordinary person skilled in the art without paying any creative effort fall within the protection scope of the present disclosure.

In the description of the present disclosure, it should be understood that orientation or location relationships indicated by terms "up", "down", "left", "right", "vertical", "horizontal", "inside", "outside" and the like are the orientation or location relationships based on the accompanying drawings, provided just for ease of describing the present disclosure and simplifying the description. They are not intended to indicate or imply that the stated devices or elements must have the specific orientation and be constructed and operated in the specific orientation. Hence, they shall not be understood as any limitation to the present disclosure.

Terms "first" and "second" are simply used for description, and shall not be understood to indicate or imply relative importance or to imply the amount of the stated technical features. Therefore, features defined with "first" and "second" can explicitly or impliedly include one or more such features.

For a refrigerator with ice making and ice crushing functions, these functions are usually achieved by adding an ice maker to the refrigerator. The ice maker may be provided on a refrigerator door of the refrigerator, or the ice maker may also be provided inside the refrigerator such as in a freezing chamber of the refrigerator. The embodiments of the present disclosure do not give limitations on the provided position of the ice maker.

Figure 13:
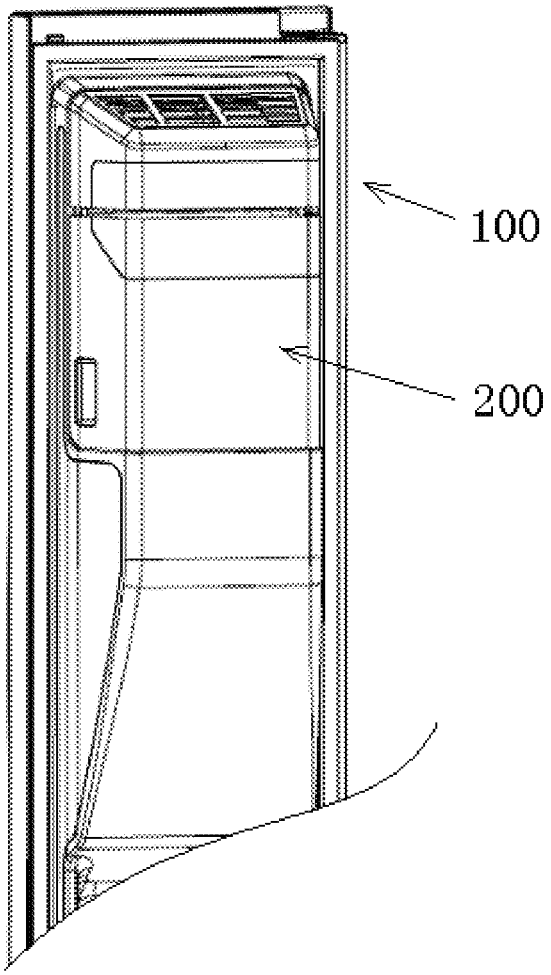
FIG. 13 is a schematic structure diagram of a refrigerator, an inner wall of the refrigerator door thereof is provided with an ice crushing device according to one embodiment of the present disclosure.

Exemplarily, with reference to FIG. 13, a refrigerator door 100 of the refrigerator may be provided with an ice maker, which may comprise an ice making device and an ice crushing device 200. The ice making device conveys the prepared ice cubes into an ice storage container of the ice crushing device 200. When users need to access complete ice cubes, the ice cubes in the ice storage container are discharged, or when users need to access crushed ice cubes, the ice cubes in the ice storage container are discharged after being crushed.

The ice making device conveys the ice cubes into the ice storage container 5 after finishing the preparation of the ice cubes. A rotatable stirrer 1 and a rotatable ice knife assembly 2 are provided in the ice storage container 5. The stirrer 1 and the ice knife assembly 2 drive the ice cubes within the ice storage container 5 to move by rotating themselves, and discharge complete ice cubes or crushed ice cubes after crushing the ice cubes in accordance with the actual needs of users.

Figure 1A:
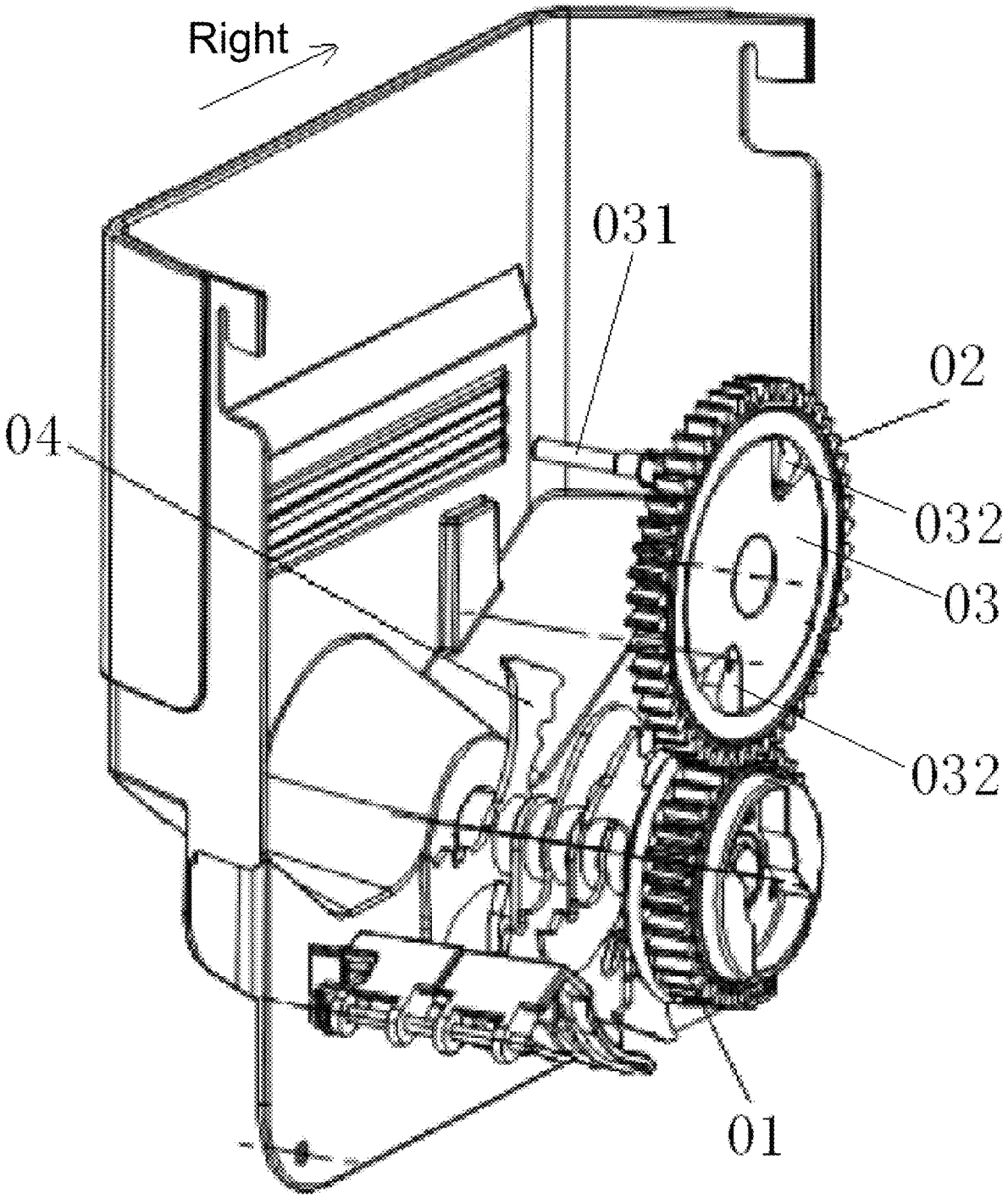
Fig.1a (PRIOR ART)
FIG. 1*a* is a schematic structure diagram of an ice crushing device of an ice maker provided in the prior art.
Figure 1B:
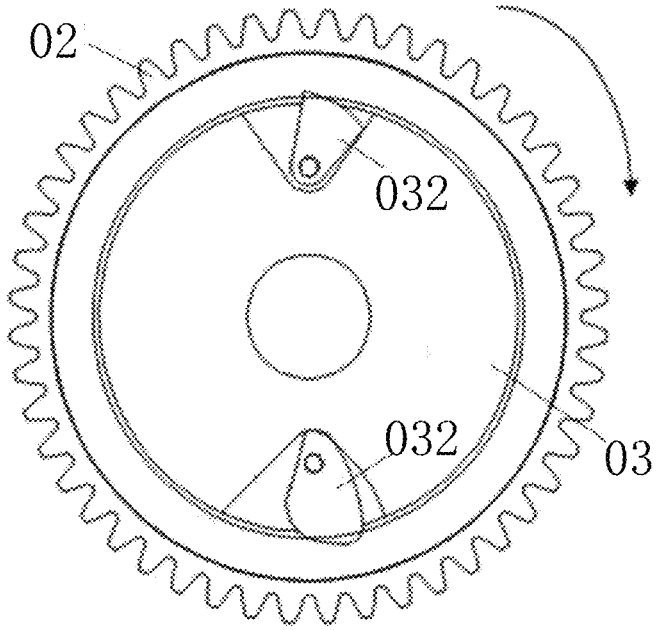
Fig.1b (PRIOR ART)
FIG. 1*b* is a schematic structure diagram of a driven gear in FIG. 1*a* when it rotates clockwise.
Figure 1C:
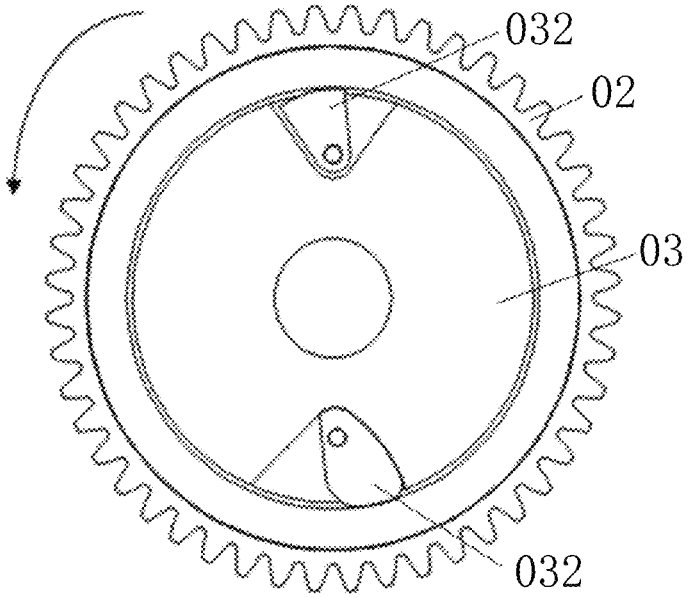
Fig.1c (PRIOR ART)
FIG. 1*c* is a schematic structure diagram of a driven gear in FIG. 1*a* when it rotates anticlockwise.

Exemplarily, FIG. 1*a* shows an ice making device in the prior art CN201210285480, including a driving gear 01, a driven gear 02, an ice stirrer 03 with a wheeled main body, an ice stirring bar 031 provided on the ice stirrer 03. The driving gear 01 is meshed with the driven gear 02. The driving gear 01 is coaxially sleeved with a plurality of ice crushing blades 04 used for cutting the ice cubes. Ice crushing blades 04 are spaced by a certain distance respectively. The driven gear 02 is a hollow ring structure so that the ice stirrer 03 is coaxially sleeved with the driven gear 02, and that a circle of gap forms between the outer peripheral surface of the ice stirrer 03 and the inner ring surface of the driven gear 02 as shown in FIG. 1*a*, FIG. 1*b* and FIG. 1*c*. Two fan-shaped eccentric wedges 032 are symmetrically provided on the ice stirrer 03.

As shown in FIG. 1*a*, when the driving gear 01 rotates anticlockwise, it drives the driven gear 02 to rotate clockwise. As shown in FIG. 1*b*, friction force is produced between the two fan-shaped eccentric wedges 032 and the driven gear 02, driving the ice stirrer 03 to operate. At this time, the ice crushing device is in the mode of crushed ice, the ice crushing blades 04 cut the ice cubes into pieces, and the ice stirrer 03 stirs normally to prevent the crushed ice cubes from being stuck together, thus obtaining the crushed ice cubes as needed. When the driving gear 01 rotates clockwise, it drives the driven gear 02 to rotate anticlockwise. As shown in FIG. 1*c*, a gap forms between the two fan-shaped eccentric wedges 032 and the driven gear 02, making the ice stirrer 03 not to operate. At this time, the ice crushing device is in the mode of complete ice cubes, and the ice stirrer 03 stops operating, thus obtaining complete ice cubes.

In this solution, only when the driving gear 01 as shown in FIG. 1*a* rotates anticlockwise, larger portions of the two eccentric wedges 032 contact with the inner ring surface of the driven gear 02 to produce friction force, and the driven gear 02 then is capable of driving the ice stirrer 03 to rotate (as shown in FIG. 1*b*). At this time, the ice crushing blades 04, the ice stirrer 03 and the ice stirring bar 031 simultaneously produce a force in the right direction on the ice cubes as shown in FIG. 1*a* to make the ice cubes within the container move. When the driving gear 01 rotates clockwise, a gap forms between smaller portions of the two eccentric wedges 032 and the inner ring surface of the driven gear 02 (as shown in FIG. 1*c*), thus the ice stirrer 03 and the driven gear 02 are disengaged so that the driven gear 02 is incapable of driving the ice stirrer 03 to rotate and the ice stirrer 03 stops working. However, even when the ice stirrer 03 operates, all the forces that make the ice cubes move are in the same direction (the right direction as shown in FIG. 1*a*). Therefore, the ice cubes move towards the right direction in the container as a whole, and the relative movement between the ice cubes is not significant and the stirring effect is not obvious.

FIG. 2, FIG. 3, FIG. 4, and FIG. 5 as shown are one specific embodiment of the ice crushing device according to the embodiments of the present disclosure. The ice crushing device in this embodiment comprises an ice storage container 5, a rotatable stirrer 1 is provided in the ice storage container 5, a rotatable ice knife assembly 2 is provided below the stirrer 1, and the axis of a rotary shaft 11 of the stirrer 1 and the axis of a rotary shaft 21 of the ice knife assembly 2 are mutually on lines in different planes.

Thus compared with the prior art, with regard to the ice crushing device provided by the embodiments of the present disclosure, the axis of the rotary shaft 11 of the stirrer 1 and the axis of the rotary shaft 21 of the ice knife assembly 2 are mutually skew lines. Therefore, the line in the direction of the acting force on the ice cubes when the stirrer 1 rotates and the line in the direction of the acting force on the ice cubes when the ice knife assembly 2 rotates are mutually skew lines, that is, when the stirrer 1 stirs, disturbance may happen between the stirrer 1 and the ice knife assembly 2, capable of making the ice cubes do irregular movement within the ice storage container 5. The relative movement between the ice cubes increases, and the stirring effect of the stirrer 1 may be effectively optimized, thus it may avoid or reduce that the adjacent ice cubes contact for a long time to freeze together due to the unobvious relative movement between them.

Figure 2:
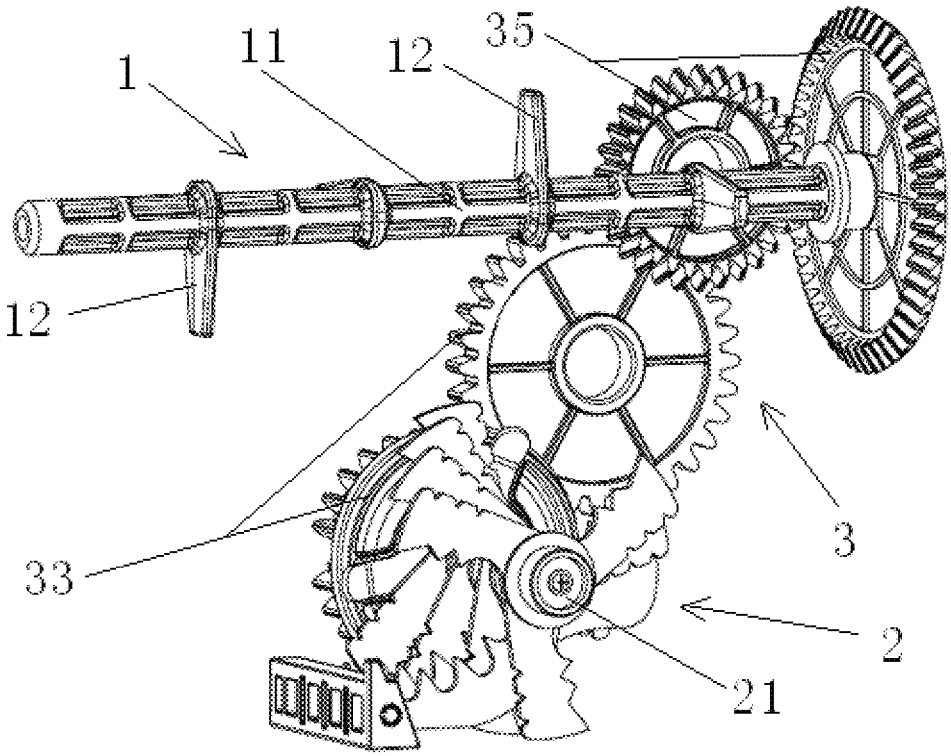
FIG. 2 is a dimensional schematic structure diagram of an ice crushing device according to one embodiment of the present disclosure.
Figure 3:
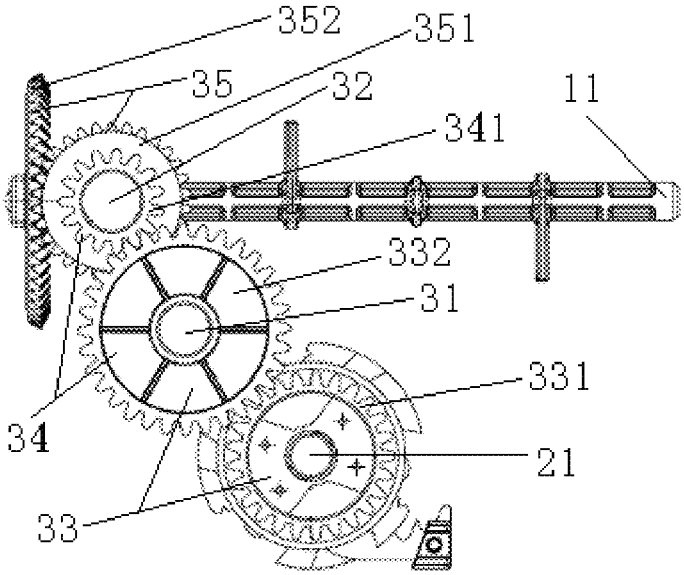
FIG. 3 is a main view of schematic diagram of an ice crushing device according to one embodiment of the present disclosure.
Figure 4:
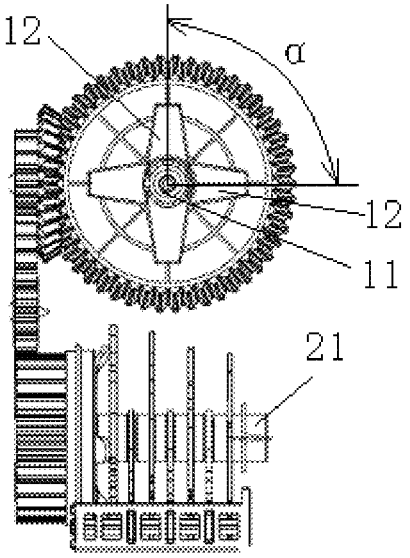
FIG. 4 is a left view of schematic diagram of an ice crushing device according to one embodiment of the present disclosure.

In one embodiment, in order to make the stirring effect of the stirrer 1 better, with reference to FIG. 2, FIG. 3 and FIG. 4 as shown, the axis of the rotary shaft 11 of the stirrer 1 and the axis of the rotary shaft 21 of the ice knife assembly 2 are mutually perpendicular. When the axis of the rotary shaft 11 of the stirrer 1 and the axis of the rotary shaft 21 of the ice knife assembly 2 are mutually perpendicular, the direction of the acting force generated by the stirrer 1 and the direction of the acting force generated by the ice knife assembly 2 when the ice knife assembly 2 rotates are also mutually perpendicular. There is no component force in the same direction and the disturbance effect within the ice storage container 5 may be effectively optimized, so that the stirring effect of the stirrer may be optimized at the same time.

In one embodiment, with reference to FIG. 2, FIG. 3 and FIG. 4 as shown, the rotary shaft 11 of the stirrer 1 and the rotary shaft 21 of the ice knife assembly 2 are both arranged horizontally. When the rotary shaft 11 of the stirrer 1 and the rotary shaft 21 of the ice knife assembly 2 are both arranged horizontally, during the operation process of the ice crushing device, the force of the rotary shaft 11 of the stirrer 1 in the axial direction may be uniformly distributed during its rotation process, thus it may avoid the situation that some portion is subjected so excessive force that bending or fracture happens; moreover, during the accumulation process of the ice cubes in the ice storage container, both sides of the ice crushing blades of the ice knife assembly 2 are subjected to an equal force. Besides, the knife edge and knife back are not easily squeezed due to their excessively small area. During the rotation process, both sides of the ice crushing blades of the ice knife assembly 2 may only need to overcome the friction force with the ice cubes, thus making the ice crushing blades of the ice knife assembly 2 basically not to bend during the rotation process. However, if the rotary shaft 11 of the stirrer 1 is arranged obliquely, after the side of the rotary shaft 11 of the stirrer 1 close to the ice making unit is squeezed by the ice cubes, the force generated by squeezing basically cannot be uniformly distributed over the entire shaft, and the installation portion of the shaft is more likely to be bent; if the rotary shaft 21 of the ice knife assembly 2 is arranged obliquely, during the operation process of the ice crushing device, the knife faces of the ice crushing blades of the ice knife assembly 2 will be additionally squeezed by the ice cubes so that the ice crushing blades of the ice knife assembly 2 also need to overcome the pressure from the ice cubes during the rotation process, increasing the possibility of the ice crushing blades of the ice knife assembly 2 to be bent or fracted. Meanwhile, obliquely arranging the rotary shaft 11 of the stirrer 1 and/or the rotary shaft 21 of the ice knife assembly 2 may also increase the installation difficulty of the shaft. Therefore, horizontally arranging both the rotary shaft 11 of the stirrer 1 and the rotary shaft 21 of the ice knife assembly 2 may effectively protect the stirrer 1 and the ice knife assembly 2, and may decrease the installation difficulty at the same time.

The rotary shaft 11 of the stirrer crosses the ice storage container 5 to ensure that the stirrer 1 has as large a stirring space as possible and covers the entire area above the ice knife assembly 2.

In order to make the stirring effect of the stirrer 1 better, with reference to FIG. 2, FIG. 3 and FIG. 4 as shown, a plurality of stirring claws 12 may be arranged on the rotary shaft 11 of the stirrer 1. The plurality of stirring claws 12 may be uniformly distributed in the circumferential direction of the rotary shaft 11 of the stirrer 1. When the stirrer 1 is working, the plurality of stirring claws 12 arranged on the rotary shaft 11 of the stirrer 1 can simultaneously stretch into the ice cubes from different directions to stir, increasing the stirring range of the stirrer 1. The plurality of stirring claws 12 uniformly distributed in the circumferential direction of the rotary shaft 11 of the stirrer 1 may ensure that when the stirrer 1 stirs, the rotary shaft 11 of the stirrer 1 generates basically the same acting force on the ice cubes in the circumferential direction at every moment, thus it may ensure the stability of the stirring process and basically avoid the situation of uneven stirring.

Meanwhile, the length of the stirring claws 12 in the vertical direction should be as long as possible under the circumstances of not interfering with the ice crushing blades of the ice knife assembly 2, so that the stirring range of the stirring claws 12 covers the ice storage container space above the ice crushing blades as much as possible, thus the stirring range is wider and the stirring effect of the stirrer 1 is better.

In order to ensure the stability of the rotary shaft 11 of the stirrer 1 in use, with reference to FIG. 2, FIG. 3 and FIG. 4 as shown, the plurality of stirring claws 12 may be arranged apart from each other in the axial direction of the rotary shaft 11 of the stirrer 1, and the adjacent two stirring claws 12 may be spaced in the axial direction of the rotary shaft 11 of the stirrer 1 by an equal distance. The stirring claws 12 are uniformly arranged in the axial direction of the rotary shaft 11 of the stirrer 1 so that the portion covered by the stirrer 1 may be sufficiently and uniformly stirred in the case of using the stirring claws 12 as few as possible during the stirring process of the stirrer 1, thus it may improve the stirring efficiency effectively while saving cost. The adjacent two stirring claws 12 are spaced in the axial direction of the rotary shaft 11 of the stirrer 1 by an equal distance so that when the rotary shaft 11 of the stirrer 1 rotates, the force suffered by the rotary shaft 11 may be uniformly distributed on the rotary shaft 11 of the stirrer 1 so as to may prevent the rotary shaft 11 of the stirrer 1 from being deformed or even fracted due to uneven force.

For example, with reference to FIG. 3 and FIG. 4 as shown, four stirring claws are uniformly arranged in the circumferential direction of the rotary shaft 11 of the stirrer 1, and the degree of the angle $\alpha$ formed by the adjacent two stirring claws 12 is 90°. $\alpha=360°/n$, wherein n is the number of the stirring claws 12. Four stirring claws 12 are arranged on the rotary shaft 11 of the stirrer 1, so that the four stirring claws 12 can respectively stretch into the accumulated ice cubes in four circumferential directions of the rotary shaft 11 of the stirrer 1 during the stirring process of the stirrer 1. It may be ensured that the ice cubes in the ice storage container are sufficiently stirred in the case of arranging only four stirring claws 12, and the frozen ice cubes with relatively large volume can be separated into smaller cubes which then can be separated or broken by the ice knife assembly 2, thus it may reduce the workload of the ice knife assembly 2 and may extend the service life of the ice knife assembly 2. And the four stirring claws 12 uniformly distributed in the circumferential direction of the rotary shaft 11 of the stirrer 1 may ensure that when the stirrer 1 stirs, the acting force of the rotary shaft 11 of the stirrer 1 may be uniformly distributed on the rotary shaft in the case that the stirrer 1 operates, thus it may prevent the rotary shaft 11 of the stirrer 1 from being deformed or even fracted due to uneven force and may ensure the stability of the stirring process.

In another embodiment, with reference to FIG. 3 and FIG. 4 as shown, the plurality of stirring claws 12 may all extend in a direction perpendicular to the rotary shaft 11 of the stirrer 1. When the stirring claws 12 are arranged perpendicular to the rotary shaft 11 of the stirrer 1, it may be ensured that when the rotary shaft 11 of the stirrer 1 rotates, each portion of the stirring claws 12 may be subjected to force and basically no ice cubes will be stuck between the stirring claws 12 and the rotary shaft 11 of the stirrer 1, thus it may ensure the normal operation of the stirrer 1.

With reference to FIG. 2 as shown, the rotary shaft 21 of the ice knife assembly 2 may be connected with a driving device (not shown in the figure) for driving the rotation of the rotary shaft 21 of the ice knife assembly 2. The rotary shaft 21 of the ice knife assembly 2 is connected with the rotary shaft 11 of the stirrer 1 through a transmission assembly 3 in a transmission way, so as to drive the rotation of the rotary shaft 11 of the stirrer 1. Using the transmission assembly 3 to drive the rotation of the rotary shaft 11 of the stirrer 1 compared with the driving method to directly use driving devices such as motors consumes relatively less energy and the noise is lower. The transmission assembly 3 may be a turbine transmission assembly, a chain transmission assembly, a belt transmission assembly or a gear transmission assembly.

Wherein, adopting the turbine transmission assembly may achieve a higher accuracy of transmission, and the structure is compact in size. But the turbine transmission assembly has large axial force with easy heating and low transmission efficiency. Meanwhile, the turbine transmission assembly requires a better working environment and the equipment is easy to be damaged.

Adopting the chain transmission assembly has such advantages as low installation accuracy and simple transmission structure. But the chain transmission assembly has poor transmission stability, the impact and shock resistance ability of the transmission chain is weak, and it is very easy to be damaged.

Adopting the belt transmission assembly has such advantages as simple structure and low cost. Moreover, the belt transmission assembly itself has the function to ease vibration and absorb impact, and may prevent the other components from being damaged. But in the belt transmission assembly, the service life of the belt is relatively short and the belt needs to be frequently replaced. Moreover, the belt of the belt transmission assembly is easy to slip making the transmission ratio often change, and stable operation of the machine may not be guaranteed.

With reference to FIG. 2, FIG. 3, FIG. 4 and FIG. 5 as shown, when the transmission assembly 3 is adopted with a gear transmission assembly, the transmission assembly 3 may comprise a first intermediate shaft 31 and a second intermediate shaft 32, the first intermediate shaft 31 may be transmitted with the rotary shaft 21 of the ice knife assembly 2 through a first cylindrical gear set 33, the first intermediate shaft 31 may be transmitted with the second intermediate shaft 32 through a second cylindrical gear set 34, and the second intermediate shaft 32 may be transmitted with the rotary shaft 11 of the stirrer 1 through a bevel gear set 35.

The first cylindrical gear set 33 may include a first cylindrical gear 331 fixedly sleeved to the rotary shaft 21 of the ice knife assembly 2 and a second cylindrical gear 332 fixedly sleeved to the first intermediate shaft 31. And the first cylindrical gear 331 and the second cylindrical gear 332 are meshed to ensure that the first intermediate shaft 31 can rotate synchronously when the rotary shaft 21 of the ice knife assembly 2 is driven by the driving device (not shown in the figure). At this time, the rotary shaft 21 of the ice knife assembly 2 and the first intermediate shaft 31 are parallel to each other.

The second cylindrical gear set 34 may include the second cylindrical gear 332 and a third cylindrical gear 341 fixedly sleeved to the second intermediate shaft 32. And the second cylindrical gear 332 and the third cylindrical gear 341 are meshed to ensure that the second intermediate shaft 32 can rotate synchronously when the first intermediate shaft 31 rotates. At this time, the first intermediate shaft 31 and the second intermediate shaft 32 are parallel to each other, that is, the rotary shaft 21 of the ice knife assembly 2, the first intermediate shaft 31 and the second intermediate shaft 32 are also parallel to each other.

The bevel gear set 35 may include a first bevel gear 351 fixedly sleeved to the second intermediate shaft 32 and a second bevel gear 352 fixedly sleeved to the rotary shaft 11 of the stirrer 1. And the first bevel gear 351 and the second bevel gear 352 are meshed, so that when the second intermediate shaft 32 rotates, it may drive the first bevel gear 351 fixedly sleeved thereto to rotate, thus driving the second bevel gear 352 meshed with the first bevel gear 351 to rotate, further driving the rotary shaft 11 of the stirrer 1 sleeved in the second bevel gear 352 to rotate, thus the stirrer 1 starts to stir. As the axis of a rotary shaft 11 of the stirrer 1 and the axis of a rotary shaft 21 of the ice knife assembly 2 are inevitably mutually skew lines, the rotary shaft 11 of the stirrer 1 fixedly sleeved in the second bevel gear 352, and the second intermediate shaft 32 fixedly sleeved in the first bevel gear 351 must also have a certain angle β. If a cylindrical gear meshing is adopted, it is impossible to realize the transmission as needed between the rotary shaft 11 of the stirrer 1 and the second intermediate shaft 32. But the angle of the shafts when bevel gears are meshed may meet this requirement. It only needs to calculate out each required parameter of the bevel gear according to the actual angle of the angle β in use, and select the appropriate bevel gear set 35 to carry out the transmission, further to meet the requirements of the embodiments of the present disclosure and implement the embodiments of the present disclosure. Moreover, the bevel gear itself has a long service life and may carry a larger load, which may also ensure the stable operation of the ice crushing device to a certain extent.

When the gear transmission assembly is adopted to drive the rotary shaft 11 of the stirrer 1, the structure of the gear transmission assembly itself is relatively simple, and the stability and the efficiency of the transmission are both relatively high, making the reliability of the transmission work also relatively high due to its relatively high stability itself. The gear itself has a relatively high hardness and the requirements of the gear transmission assembly for the installation environment are not high, which makes the service life of the gear transmission assembly relatively long correspondingly. When the rotary shaft 11 of the stirrer 1 is driven by the gear transmission assembly, the operation of the stirrer 1 is smoother, and the noise is lower. Moreover, the service life of the transmission assembly 3 adopted with gear transmission assembly is relatively long, and there is basically no need to frequently replace the components in the transmission assembly 3, thus it may enhance the continuous operation ability of the stirrer 1.

As can be seen from the above description, in the above embodiment, the transmission assembly 3 mainly refers to intermediate elements for interlocking the rotary shaft 21 with the rotary shaft 11. The transmission assembly 3 may include a first cylindrical gear 331 fixedly sleeved to the rotary shaft 21, a second cylindrical gear 332 meshed with the first cylindrical gear 331, a first intermediate shaft 31 used for setting the second cylindrical gear 332, a third cylindrical gear 341 meshed with the second cylindrical gear 332, a second intermediate shaft 32 used for setting the third cylindrical gear 341, a first bevel gear 351 coaxially provided with the third cylindrical gear 341, and a second bevel gear 352 meshed with the first bevel gear 351.

In the above embodiment, the driving device is connected with the rotary shaft 21 of the ice knife assembly 2; alternatively, in other embodiments, the driving device may be connected with a certain element in the transmission assembly 3, such as the first intermediate shaft 31, the second intermediate shaft 32, the first cylindrical gear 331, the second cylindrical gear 332, the third cylindrical gear 341, the first bevel gear 351 or the second bevel gear 352 in the transmission assembly 3. In conclusion, as long as the driving device is capable of driving the rotary shaft 21 of the ice knife assembly 2 and the rotary shaft 11 of the stirrer 1 to rotate so as to ensure the normal operation of the ice knife assembly 2 and the stirring claws 12, the embodiments of the present disclosure do not give limitation on this.

Figure 6:
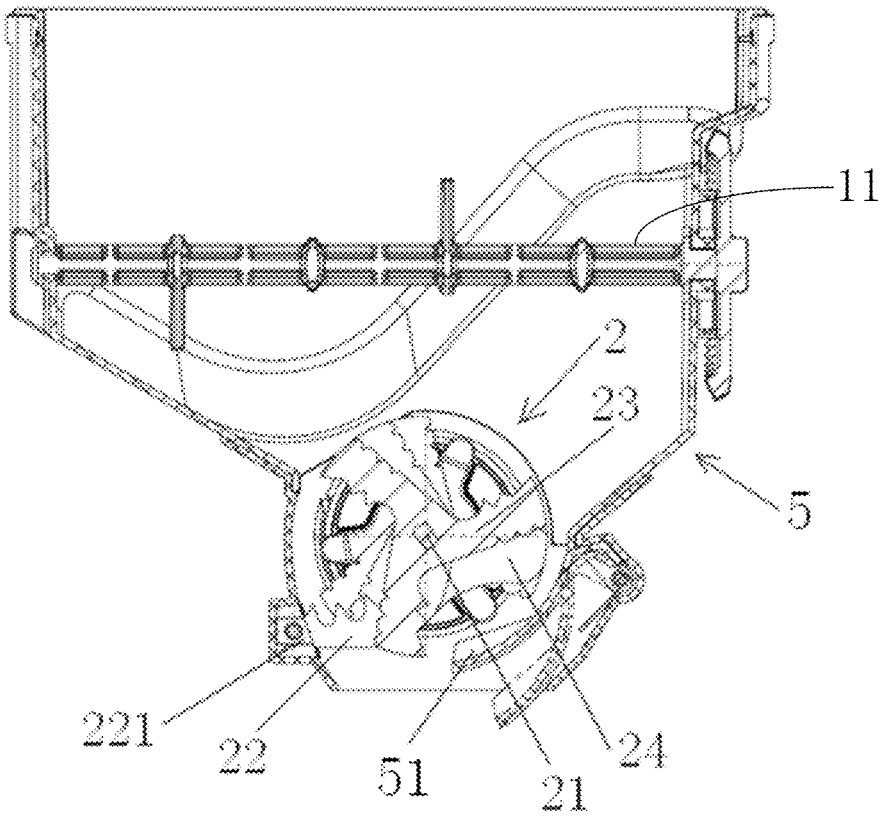
FIG. 6 is a main view of schematic diagram of an ice crushing device with an ice cube separation structure according to one embodiment of the present disclosure.
Figure 7:
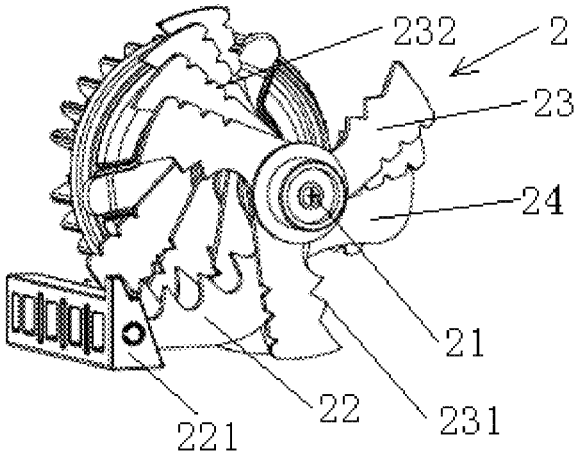
FIG. 7 is a dimensional schematic structure diagram of an ice knife assembly of an ice crushing device according to one embodiment of the present disclosure.

When users access complete ice cubes in the mode of ice cubes, sometimes the situation that no ice cubes are discharged may happen. After research, those skilled in the art find the reason that some frozen ice cubes block the outlet of the complete ice cubes. Therefore, in order to solve the problem that frozen ice cubes block the outlet of the complete ice cubes, another ice crushing device is provided by another embodiment of the present disclosure, and the ice crushing device may comprise the following structures:

With reference to FIG. 6 and FIG. 7 as shown, the ice crushing device may comprises a ice storage container 5, in which a rotatable ice knife assembly 2 is provided, wherein the ice knife assembly 2 may comprise a rotary shaft 21, a fixed ice knife 22, a movable ice knife 23 and an ice cube separation structure 24, the rotary shaft 21 can drive the movable ice knife 23 to rotate, the fixed ice knife 22 and the ice cube separation structure 24 may be located at two sides of the rotary shaft 21 separately, and the fixed ice knife 22 and the ice cube separation structure 24 are both fixed relative to the ice storage container 5. When the rotary shaft 21 drives the movable ice knife 23 to rotate in the first direction, the ice cubes within the ice storage container 5 may be broken under the shear force of the movable ice knife 23 and the fixed ice knife 22. When the rotary shaft 21 drives the movable ice knife 23 to rotate in the second direction opposite to the first direction, the frozen ice cubes may be separated under the cooperation of the movable ice knife 23 and the ice cube separation structure 24. The fixed ice knife 22 and the ice cube separation structure 24 are provided on two sides of the rotary shaft 21 separately, so that when the rotary shaft 21 rotates in the first direction in the mode of crushed ice for the ice crushing device, the movable ice knife 23 presses downward the direction in which the fixed ice knife 22 is located, cutting the ice cubes between the movable ice knife 23 and the fixed ice knife 22; when the rotary shaft 21 rotates in the second direction opposite to the first direction in the mode of ice cubes, the movable ice knife 23 presses downward the direction in which the ice cube separation structure 24 is located, applying a downward force to the upper surface of the frozen ice cubes between the ice cube separation structure 24 and the movable ice knife 23, while the contact portion of the ice cube separation structure 24 and the lower surface of the frozen ice cubes provides a corresponding support force; so that the frozen ice cubes are separated into ice cubes. Therefore, when users access complete ice cubes in the mode of ice cubes, the situation that the frozen ice cubes block the outlet of the complete ice cubes basically may not happen.

Figure 8:
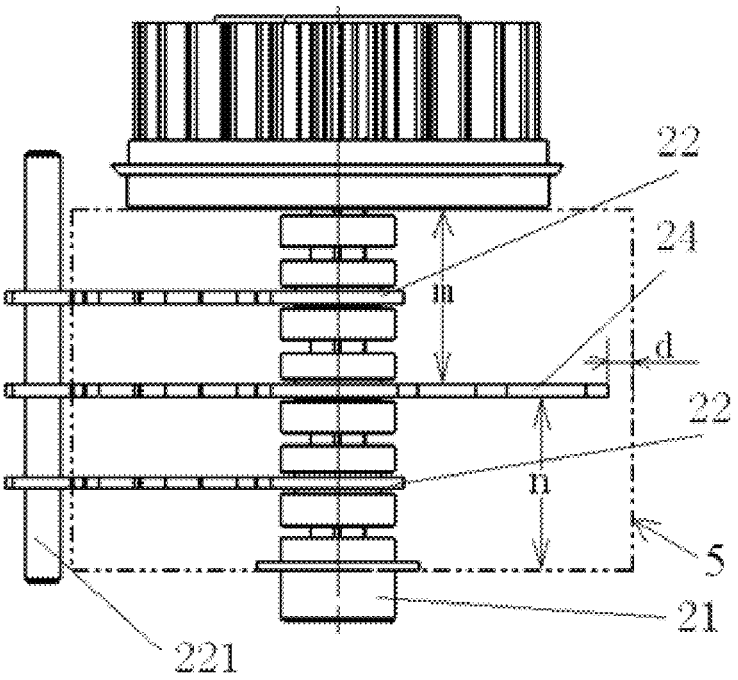
FIG. 8 is a top view of schematic diagram of a fixed ice knife in an ice knife assembly of an ice crushing device according to one embodiment of the present disclosure.

Further, with reference to FIG. 7 and FIG. 8 as shown, one end of the fixed ice knife 22 may be rotatably connected to the rotary shaft 21, the other end may be fixedly connected to a fixed base 221 which is fixed relative to the ice storage container 5, and the ice cube separation structure 24 may be fixed at the end of the fixed ice knife 22 connected to the rotary shaft 21 and may extend substantially along the longitudinal direction of the fixed ice knife 22.

Alternatively, the ice cube separation structure 24 may be fixedly provided within the ice storage container 5 instead of being fixed to one end of the fixed ice knife 22. For example, one end of the ice cube separation structure 24 is directly fixed within the ice storage container 5, the connection portion between the ice cube separation structure 24 and the ice storage container 5 and the fixed base 221 for connecting the fixed ice knife 2 are separately provided on two sides of the rotary shaft 21, and the other end of the ice cube separation structure 24 extends substantially toward the radial direction of the rotary shaft 21 (but not connected to the rotary shaft 21).

But when the ice cube separation structure 24 works, the edge of the connection portion between the ice cube separation structure 24 provided within the ice storage container 5 and the ice storage container 5 may also be subjected to a shear force to a certain degree, and it is difficult for the connection portion to provide an individual support force. Long-time use will reduce the reliability of the connection portion and even cause the ice cube separation structure 24 to fall off from the connection portion. On the contrary, when the ice cube separation structure 24 is connected to one end of the fixed ice knife 22 connected to the rotary shaft 21, both the fixed base 221 fixedly provided relative to the ice storage container 5 and the rotary shaft 21 may provide sufficient support force for counteracting the force on the ice cube separation structure 24 when the ice cube separation structure 24 is subjected to forces, so that the ice cube separation structure 24 itself may be subjected to less force and the service life of the ice cube separation structure 24 may be extended.

Figure 9:
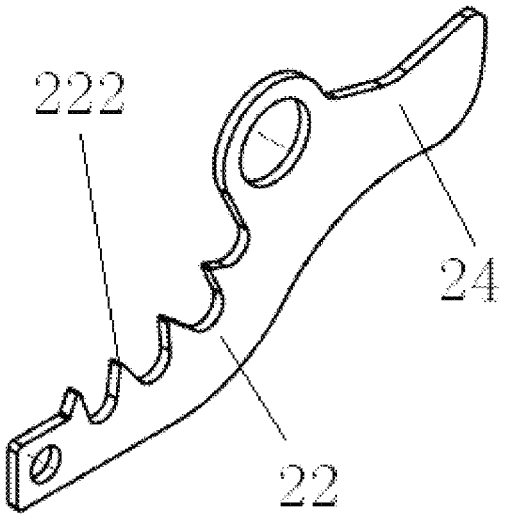
FIG. 9 is a dimensional schematic structure diagram in which a fixed ice knife in the ice knife assembly and an ice cube separation structure in the ice crushing device are integrally formed according to one embodiment of the present disclosure.
Figure 10:
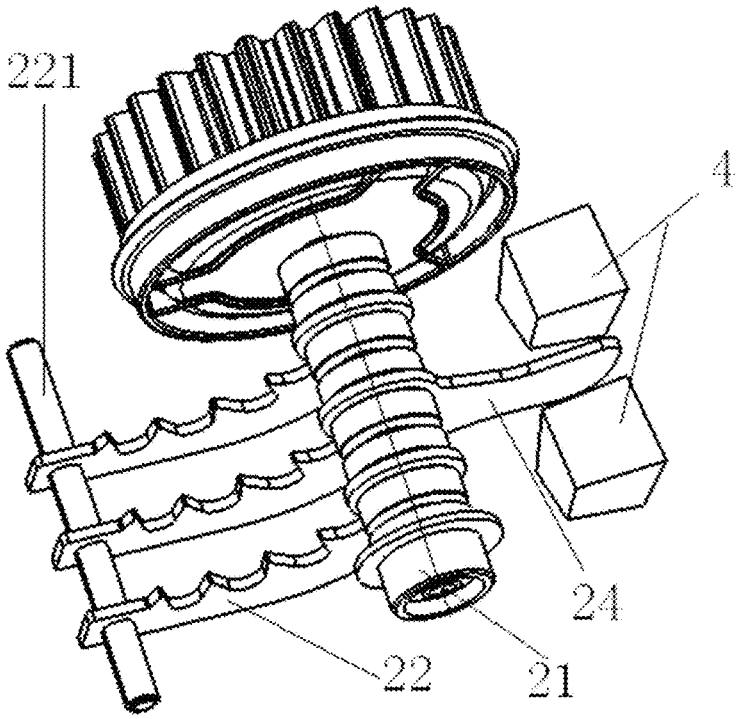
FIG. 10 is a dimensional schematic structure diagram in which a fixed ice knife and an ice cube separation structure in the ice crushing device are integrally formed in use state according to one embodiment of the present disclosure.
Figure 11:
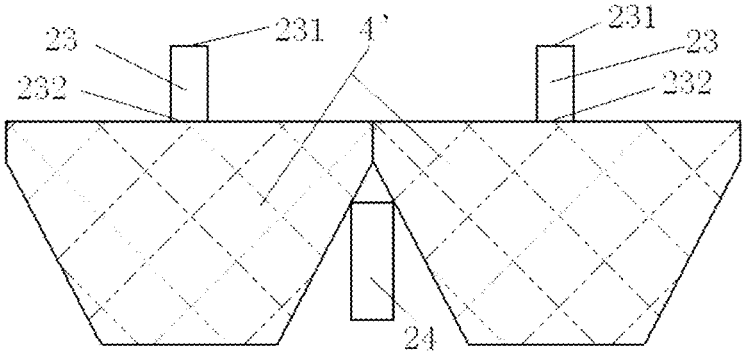
FIG. 11 is a schematic diagram in which an ice cube separation structure in an ice crushing device separates frozen ice cubes according to one embodiment of the present disclosure.
Figure 12:
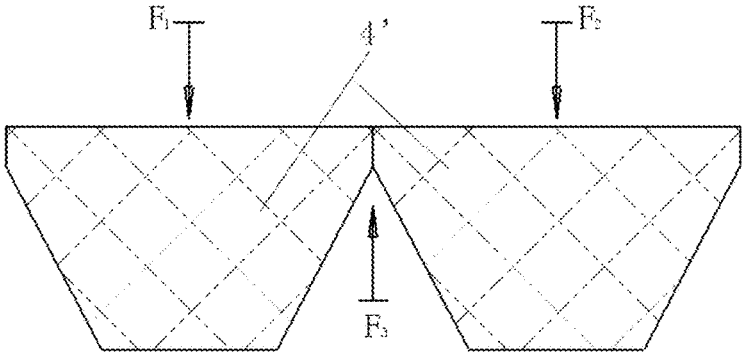
FIG. 12 is an analysis diagram of forces on the frozen ice cubes when an ice cube separation structure in an ice crushing device separates frozen ice cubes according to one embodiment of the present disclosure.

In order to reduce the situations where the reliability of the connection portion in long-time use is reduced as mentioned in the above embodiments, with reference to FIG. 7, FIG. 8 and FIG. 9 as shown, the ice cube separation structure 24 is a plate-shape structure, and is integrally formed with the fixed ice knife 22. The plate-shape ice cube separation structure 24 is easier to be installed. After the ice cube separation structure 24 is integrally formed with the fixed ice knife 22, there is no need for an additional connection portion between the ice cube separation structure 24 and the fixed ice knife 22 because the connection process is not adopted therebetween, so that the situations where the connection portion is disconnected due to reduced connection reliability in long-time operation basically will not happen, and the operation stability of the ice crushing device is ensured. In order to reduce the process difficulty of integrally forming the ice cube separation structure 24 and the fixed ice knife 22, optionally, the ice cube separation structure 24 and the fixed ice knife 22 may be arranged with the same thickness.

In some other embodiments, there may also be other fixation means between the fixed ice knife 22 and the ice cube separation structure 24, for example, one end of the fixed ice knife 22 is directly connected to one end of the ice cube separation structure 24 (but may not be rotatably connected to the rotary shaft 21), the other end of the fixed ice knife 22 is fixedly connected to the fixed base 221 which is fixed relative to the ice storage container 5, so that the fixed ice knife 22 is provided in a substantially straight line with the ice cube separation structure 24, the other end of the ice cube separation structure 24 is directly fixed within the ice storage container 5, and the connection portion between the ice cube separation structure 24 and the ice storage container 5 and the fixed base 221 are separately provided on two sides of the rotary shaft 21; or, one end of the fixed ice knife 22 may be rotatably connected to the rotary shaft 21, the other end is fixedly connected to the fixed base 221 which is fixed relative to the ice storage container 5, one end of the ice cube separation structure 24 is fixed at the end of the fixed ice knife 22 connected to the rotary shaft 21 and extends substantially along the longitudinal direction of the fixed ice knife 22, the other end of the ice cube separation structure 24 is fixed within the ice storage container 5, and the connection portion between the ice cube separation structure 24 and the ice storage container 5 and the fixed base 221 are separately provided on two sides of the rotary shaft 21; or, one end of the fixed ice knife 22 may be rotatably connected to the rotary shaft 21, and the other end is fixedly connected to the fixed base 221 which is fixed relative to the ice storage container 5, one end of the ice cube separation structure 24 may be rotatably connected to the rotary shaft 21 (but the fixed ice knife 22 is not connected to the ice cube separation structure 24), the other end of the ice cube separation structure 24 is fixed within the ice storage container 5, and the connection portion between the ice cube separation structure 24 and the ice storage container 5 and the fixed base 221 are separately provided on two sides of the rotary shaft 21.

A person skilled in the art should understand that through the above description the other fixation means between the fixed ice knife 22 and the ice cube separation structure 24 which may also be thought of by the person skilled in the art without paying creative effort shall all be covered within the scope of the present disclosure.

Figure 5:
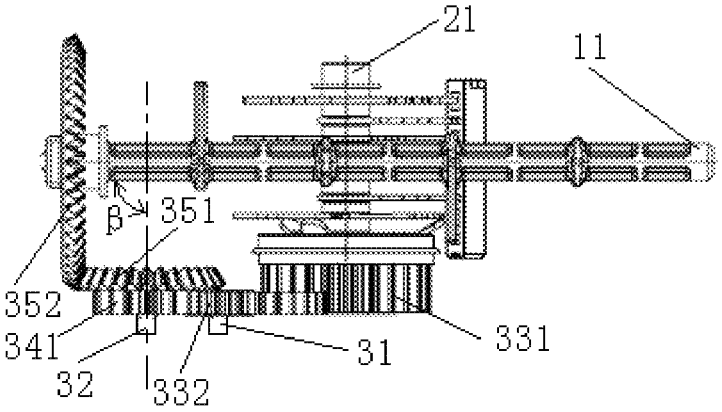
FIG. 5 is a top view of schematic diagram of an ice crushing device according to one embodiment of the present disclosure.

In order to accommodate the demand of different equipments in size or the efficiency of crushing ice, with reference to FIG. 6 to FIG. 5 as shown, a plurality of fixed ice knives 22 are provided, the movable ice knife 23 is provided on the rotary shaft 21 between two adjacent fixed ice knives 22, at least one of the fixed ice knives 22 are connected with the ice cube separation structure 24, and a gap between an inner wall of the ice storage container 5 and a closer ice cube separation structure 24 in the axial direction of the rotary shaft allows only one independent ice cube to pass through.

Alternatively, at least two of the fixed ice knives 22 are connected with the ice cube separation structure 24, and a gap between two adjacent ice cube separation structures 24 allows only one independent ice cube to pass through. In this case, a gap between the inner wall of the ice storage container 5 and a closer ice cube separation structure 24 in the axial direction of the rotary shaft may also allow only one independent ice cube to pass through.

Under normal circumstances, the size of ice cubes is determined by the size of cells in an ice making trays of the ice making device, since the ice cubes are making in the cells of the ice making trays. Here the independent ice cube refers to one that is prepared by any one cell in the ice making trays in the ice making device and not frozen with other ice cubes. Then, the gap between two adjacent ice cube separation structures 24 may allow one independent ice cube prepared by one cell of the ice making tray to pass through, that is to say, the gap between two adjacent ice cube separation structures 24 may be set in accordance with the size of cells in the ice making trays, for example, the gap may be made slightly larger than the largest size of three-dimensional sizes of one cell in the ice making tray and smaller than twice of the smallest size of three-dimensional sizes of the cell in the ice making tray.

The number of the fixed ice knives 22, the movable ice knives 23 and the ice cube separation structures 24 in the present device may be selected according to actual requirements, which increases the flexibility of the ice crushing device. Under normal circumstances, the number of the fixed ice knives 22 is greater than the number of the ice cube separation structures 24, and the distance between two adjacent fixed ice knives in the axial direction of the rotary shaft 21 and the gap between the inner wall of the ice storage container 5 and a closer fixed ice knife 22 in the axial direction of the rotary shaft 21 are both smaller than the distance between two adjacent ice cube separation structures 24 in the axial direction of the rotary shaft 21 and/or the gap between the inner wall of the ice storage container 5 and a closer ice cube separation structure 24 in the axial direction of the rotary shaft 21 so as to ensure that the crushed ice cubes cut by the action of the fixed ice knives 22 and the movable ice knives 23 are smaller than the independent ice cubes separated by the interaction of the movable ice knives 23 and the ice cube separation structures 24.

The fixed ice knife 22 and the movable ice knife 23 are provided alternately, which ensures that in the mode of crushed ice, when the rotary shaft 21 rotates in the first direction, the movable ice knife 23 presses downward the direction in which the fixed ice knife 22 is located, each ice cube located between the movable ice knife 23 and the fixed ice knife 22 may be cut into pieces under the cooperation of the movable ice knife 23 and the fixed ice knife 22. At the instant when the fixed ice knife 22 and the movable ice knife 23 stagger and both sides of the fixed ice knife 22 are the movable ice knives 23, the fixed ice knife 22 provides an upward support force on the ice cube toward the side of the movable ice knife 23, the movable ice knives 23 on both sides of the fixed ice knife 22 provide a downward force on the ice cube, so that the ice cube may be cut into pieces under the cooperation of the movable ice knife 23 and the fixed ice knife 22. If one or both sides of the fixed ice knife 22 mounted on the rotary shaft 21 are still fixed ice knife, it may result in that the fixed ice knife 22 and the fixed ice knife on one or both sides thereof cannot cooperate with the movable ice knives 23 in the mode of crushed ice, and that the ice cubes near the fixed ice knife 22 and the fixed ice knife on one or both sides thereof basically cannot be cut into pieces; similarly, if one or both sides of the movable ice knife 23 mounted on the rotary shaft 21 are still movable ice knife, the movable ice knife 23 basically cannot cooperate with the movable ice knife on one or both sides thereof in the mode of crushed ice, and the ice cubes near the movable ice knife 23 and the movable ice knife 23 on one or both sides thereof basically cannot be cut into pieces.

A plurality of ice cube separation structures 24 are arranged and the gap between two adjacent ice cube separation structures 24 may allow only one independent ice cube to pass through, which basically ensures that when the rotary shaft 21 rotates in the second direction in the mode of ice cubes, the ice cubes separated by the movable ice knife 23 and the ice cube separation structure 24 may pass through the gap and the outlet of the complete ice cubes to facilitate people's access.

For example, with reference to FIG. 6, FIG. 7, FIG. 8 and FIG. 10 as shown, the number of the fixed ice knives 22 is three, and the intermediate fixed ice knife is connected to the ice cube separation structure 24, both the gap m and gap n between the ice cube separation structure 24 21 and the inner wall of the ice storage container 5 in the axial direction of the rotary shaft may only allow an independent ice cube 4 to pass through. Here the independent ice cube refers to one that is prepared by any one cell in the ice making trays in the ice making device and not frozen with other ice cubes. That is to say, the gap m and gap n between the ice cube separation structure 24 and the inner wall of the ice storage container 5 in the axial direction of the rotary shaft 21 may also be set in accordance with the size of cells in the ice making trays. For example, the gap m and gap n may be made slightly larger than the largest size of three-dimensional sizes of one cell in the ice making tray and smaller than twice of the smallest size of three-dimensional sizes of the cell in the ice making tray.

In the present embodiment, three fixed ice knives 22 and four movable ice knives 23 are provided alternately, and when the rotary shaft 21 rotates in the first direction, the ice crushing device may cut the ice cubes between the fixed ice knives 22 and the movable ice knives 23; when the rotary shaft 21 rotates in the second direction opposite to the first direction, the movable ice knives 23 may cooperate with the ice cube separation structures 24 to separate the frozen ice cubes. And when the frozen ice cubes are separated to be able to pass through the gap m and gap n, the separated ice cubes may be transported to the outlet of the complete ice cubes and slide out from the outlet of the complete ice cubes.

In one embodiment as shown in FIG. 6, FIG. 7, FIG. 9 and FIG. 10, the size of the fixed ice knives 22 is substantially the same as the size of the movable ice knives 23, the length of the ice cube separation structures 24 is slightly smaller than the length of the fixed ice knives 22 and the movable ice knives 23. Alternatively, the size of the ice cube separation structures 24 is substantially the same as the size of the fixed ice knives 22 and the movable ice knives 23.

In another embodiment, with reference to FIG. 6, FIG. 7, FIG. 11 and FIG. 12 as shown, the movable ice knife 23 may include a knife edge 231 and a knife back 232. When the rotary shaft 21 drives the movable ice knife 23 to rotate in the first direction, the knife edge 231 of the movable ice knife 23 cooperates with a knife edge 222 of the fixed ice knife 22 to cut the ice cubes in the ice storage container 5. When the rotary shaft 21 drives the movable ice knife 23 to rotate in the second direction, the knife back 232 of the movable ice knife 23 cooperates with the ice cube separation structure 24 to separate the frozen ice cubes. When the rotary shaft 21 rotates in the first direction in the mode of crushed ice, the movable ice knife 23 needs to cooperate with the fixed ice knife 22 to cut the ice cubes. Therefore, in the mode of crushed ice, the force provided by the movable ice knife 23 and the fixed ice knife 22 is required to be bigger, which increases the load of the driving device of the driving rotary shaft 21. If the movable ice knife 23 is provided with the knife edge 231 and the knife back 232, when the knife edge 231 of the movable ice knife 23 presses downward the fixed ice knife 22, the thinner knife edge 231 may provide greater pressure than the thicker knife back 232 in the case of the same rotational speed of the rotary shaft 21 to cooperate with the fixed ice knife 22 to cut the ice cubes. Meanwhile, in the mode of crushed ice, the portion of the fixed ice knife 22 for cooperation with the knife edge 231 of the movable ice knife 23 may also be thinned and provided as the knife edge 232 of the fixed ice knife 22 to reduce the workload of the fixed ice knife 22. When the rotary shaft 21 rotates in the second direction in the mode of ice cubes, the knife back 232 of the movable ice knife 23 presses downward the direction in which the ice cube separation structure 24 is located, applying downward force $F_1$ and $F_2$ to the upper surface of the frozen ice cubes 4' located between the ice cube separation structure 24 and the movable ice knife 23, the ice cube separation structure 24 provides a corresponding support force $F_3$ on the lower surface of the frozen ice cubes 4' which is in contact with the ice cube separation structure 24, so that the frozen ice cubes 4' are separated into ice cubes 4 under the cooperation of the knife back 232 of the movable ice knife 23 and the ice cube separation structure 24. At this time, the contact portion of the movable ice knife 23 and the frozen ice cubes 4' only needs to provide a downward force, so there is no need for thinning the movable ice knife 23. The contact portion of the movable ice knife 23 with the frozen ice cubes 4' is just the knife back 232 of the movable ice knife 23. If the knife back 232 of the movable ice knife 23 is thinned, it will not only increase the difficulty of processing and installing the movable ice knife 23, but also lead to that the integrity of the ice cubes will be destroyed when the frozen ice cubes are separated in the mode of ice cubes and it is not conducive to access complete ice cubes.

In another embodiment, with reference to FIG. 6 to FIG. 11 as shown, both the knife edge 231 of the movable ice knife 23 and the knife edge 222 of the fixed ice knife 22 may be serrated, the knife back 232 of the movable ice knife 23 may be serrated, and the end portion of the extension end of the ice cube separation structure 24 may be obliquely upturned. The serrated knife edge is sharper than the smooth thin knife edge, and may more easily cut the ice cubes when the rotary shaft 21 drives the movable ice knife 23 to rotate in the first direction, thus it may extend the service life of the movable ice knife 23 and the fixed ice knife 22. When the rotary shaft 21 drives the movable ice knife 23 to rotate in the second direction, the knife back of the movable ice knife 23 drives the ice cubes to rotate, and sends the frozen ice cubes to the ice cube separation structure 24. The knife back 232 of the movable ice knife 23 is provided as serrated, so that if the ice cubes slide along the knife back of the movable ice knife 23, the groove structure of the serrated knife back 232 may play a certain limiting role on the position where the ice cubes freeze together, thus it may avoid separation failure due to sliding force during the separation process of the frozen ice cubes.

One end of the ice cube separation structure 24 is fixedly connected to the fixed ice knife 22, and the other end extends in the direction away from the fixed ice knife 22, the end extending in the direction away from the fixed ice knife 22 is the extension end of the ice cube separation structure 24. The end portion of the extension end is obliquely upturned, relative to that the end portion of the extension end is arranged horizontally or downward obliquely, when the frozen ice cubes are separated, the ice cube separation structure 24 with end portion of the extension end being obliquely upturned has a higher separation success rate. When the frozen ice cubes slide due to subjected force as they are separated, the end portion of the extension end is obliquely upturned to better avoid the frozen ice cubes from being divorced from the ice cube separation structure 24.

When the ice cube separation structure 24 has other setting forms different from FIG. 8 and FIG. 9, the above beneficial effects may also be substantially achieved, and the details will not be repeated here.

In another embodiment, with reference to FIG. 8 as shown, there is a gap d between the ice cube separation structure 24 in the radial direction of the rotary shaft 21 and the inner wall of the ice storage container 5, and the gap d does not allow an independent ice cube to pass through. The gap d between the end face of the ice cube separation structure 24 away from the rotary shaft 21 and the inner wall of the ice storage container 5 may facilitate the installation or replacement of the ice cube separation structure 24. Since the gap d does not allow an independent ice cube to pass through, an ice cube that is bigger than the independent ice cube in size cannot pass through the gap d either, so that even the frozen ice cubes are driven to the vicinity of the gap d when the fixed ice knife 23 rotates, they cannot cross the ice cube separation structure 24 and directly slide through the gap d to the outlet of the complete ice cubes along the inner wall of the ice storage container 5. The ice cubes that may move to the outlet of the complete ice cubes are all ones that have been separated, and they will not block the outlet of the complete ice cubes, ensuring the normal operation of the ice crushing device.

In one embodiment, with reference to FIG. 6 as shown, the bottom of the side where the fixed ice knife 22 is arranged in the ice storage container 5 is provided with an ice discharging funnel (not shown in the figure), and the bottom of the side where the ice cube separation structure 24 is arranged in the ice storage container 5 is provided with an ice discharging door 51. When the ice cubes in the ice storage container 5 are driven by the ice knife assembly to rotate, there will be a certain centrifugal force. The direction of the ice cubes with the centrifugal force when they are flying out is uncertain. Once the ice discharging door 51 is provided, the ice cubes with the centrifugal force will fall on the ice discharging door 51 and then slide out along the ice discharging door 51, avoiding the situation where the ice cubes with the centrifugal force directly fly out of the ice storage container 5 and fall outside the container for accessing the ice cubes or even injure people or things nearby. The ice cubes that slide out of the ice discharging door 51 are discharged out of the ice crushing device through the ice discharging funnel for people's access.

It should be noted that the technical features in each embodiment of the present disclosure may be arbitrarily combined in the case of no conflicts to form new embodiments and achieve corresponding technical effects. For example, in the ice crushing device shown in FIG. 6 and FIG. 7, a rotatable stirrer is provided above the ice knife assembly 2, the axis of the rotary shaft 11 of the stirrer and the axis of the rotary shaft 21 of the ice knife assembly 2 are mutually skew lines. Since the technical feature and the achievable beneficial effects have been introduced above in detail, and will not be repeated here.

In another embodiment of the present disclosure, a refrigerator is also provided, wherein the refrigerator comprises an ice maker. For example, with reference to FIG. 13 as shown, an inner wall of the refrigerator door 100 thereof is provided with an ice maker. The above ice crushing device 200 is provided in the ice maker, so that the ice cubes stored in the ice storage container 5 after they are prepared by the ice making device are sufficiently stirred. The refrigerator with the function of preparing ice cubes may ensure that the prepared ice cubes will not freeze together, so that users may timely access ice cubes as needed. Moreover, the ice crushing capacity of the refrigerator is also greatly enhanced to facilitate use when the ice cubes freeze together. Meanwhile, the refrigerator can not only make the movable ice knife 23 cooperate with the fixed ice knife 22 to cut the ice cubes when the movable ice knife 23 rotates in the first direction in the mode of crushed ice, but also make the movable ice knife 23 cooperate with the ice cube separation structure 24 to separate the frozen ice cubes when the movable ice knife 23 rotates in the second direction opposite to the first direction in the mode of ice cubes, so that the separated ice cubes may pass through the outlet of the complete ice cubes, thus facilitating people's smooth access to ice cubes in the situation where they directly use the mode of ice cubes.

Since the ice crushing device used in the refrigerator of the present embodiment is the same as that provided in each embodiment of the above ice crushing device, both of them may solve the same technical problem and achieve the same expected effect.

Other configurations of the refrigerator according to the embodiments of the present disclosure have been well known to those skilled in the art and will not be described in detail herein.

The above description is merely specific implementation of the present disclosure, and the protection scope of the present disclosure is not limited thereto. Changes or replacements readily obtained by any person skilled in the art who is familiar with the technical field within the disclosed technical scope of the present disclosure should be included in the protection scope of the present disclosure. Therefore, the protection scope of the present disclosure should be subject to the protection scope of the claims.

What is claimed is:

1. A refrigerator, comprising:

a refrigerator door; and an ice maker, wherein the ice maker comprises:

an ice storage container disposed on the refrigerator door;

a stirrer provided in the ice storage container, wherein the stirrer comprises a rotary shaft and a plurality of stirring claws; the rotary shaft of the stirrer is in a first fixed position relative to the ice storage container; the plurality of stirring claws are provided on the rotary shaft of the stirrer; the plurality of stirring claws each have a longitudinal direction which is perpendicular to the rotary shaft of the stirrer; and the plurality of stirring claws are uniformly distributed in a circumferential direction of the rotary shaft of the stirrer, such that longitudinal directions of the plurality of stirring claws are spaced from each other with a same angular interval; and an ice knife assembly provided in the ice storage container, wherein the ice knife assembly comprises a rotary shaft and the rotary shaft of the ice knife assembly is in a second fixed position relative to the ice storage container, wherein the rotary shaft of the stirrer is located above the rotary shaft of the ice knife assembly, and an orthographic projection of the rotary shaft of the stirrer in a horizontal plane is perpendicular to that of the rotary shaft of the ice knife assembly in the same horizontal plane, wherein the ice maker further includes:

a driving device, the driving device being connected to the rotary shaft of the ice knife assembly; and a transmission assembly, an input end of the transmission assembly being connected to the rotary shaft of the ice knife assembly, and an output end of the transmission assembly being connected to the rotary shaft of the stirrer, so that the rotation of the rotary shaft of the ice knife assembly can drive the rotary shaft of the stirrer to rotate, wherein the transmission assembly includes:

a first intermediate shaft parallel to the rotary shaft of the ice knife assembly;

a second intermediate shaft parallel to the first intermediate shaft;

a first cylindrical gear set, wherein the rotary shaft of the ice knife assembly is connected with the first intermediate shaft through the first cylindrical gear set in a transmission manner; the first cylindrical gear set includes a first cylindrical gear and a second cylindrical gear; the first cylindrical gear is fixedly disposed on the rotary shaft of the ice knife assembly; and the second cylindrical gear is fixedly disposed on the first intermediate shaft, and engages with the first cylindrical gear;

a second cylindrical gear set, wherein the first intermediate shaft is connected with the second intermediate shaft through the second cylindrical gear set in a transmission manner; the second cylindrical gear set includes the second cylindrical gear and a third cylindrical gear; and the third cylindrical gear is fixedly disposed on the second intermediate shaft, and engages with the second cylindrical gear; and a bevel gear set, wherein the rotary shaft of the stirrer is connected with the second intermediate shaft through the bevel gear set in a transmission manner; the bevel gear set includes a first bevel gear and a second bevel gear; the first bevel gear fixedly is disposed on the second intermediate shaft; and the second bevel gear is fixedly disposed on the rotary shaft of the stirrer, and engages with the first bevel gear.

2. The refrigerator according to claim 1, wherein the rotary shaft of the stirrer is parallel to the refrigerator door, and the rotary shaft of the ice knife assembly is perpendicular to the refrigerator door.

3. The refrigerator according to claim 1, wherein the rotary shaft of the stirrer is located in a first horizontal plane, the rotary shaft of the ice knife assembly is located in a second horizontal plane, and the first horizontal plane is located above the second horizontal plane.

4. The refrigerator according to claim 1, wherein, the ice storage container includes a bottom wall and four side walls connected to the bottom wall, a first side wall and a second side wall are spaced apart from each other in a width direction of the refrigerator, and a third side wall and a fourth side wall are spaced apart from each other in a depth direction of the refrigerator;

wherein the rotary shaft of the stirrer is connected to the first side wall and the second side wall, the rotary shaft of the ice knife assembly is connected to the third side wall and the fourth side wall.

5. The refrigerator according to claim 1, wherein the plurality of stirring claws are apart from each other in a longitudinal direction of the rotary shaft of the stirrer.

6. The refrigerator according to claim 5, wherein a distance between two adjacent stirring claws of the plurality of stirring claws in the longitudinal direction of the rotary shaft of the stirrer is a constant.

7. The refrigerator according to claim 1, wherein the plurality of stirring claws include a claw portion with a plate shape;

the claw portion includes:

a first end and a second end, wherein a width of the claw portion gradually decreases from the first end to the second end;

a through hole provided on the first end, wherein the plurality of stirring claws are disposed on the rotary shaft of the stirrer through the through hole.

8. The refrigerator according to claim 1, wherein the plurality of stirring claws and the rotary shaft of the stirrer are integrated.

9. The refrigerator according to claim 1, wherein the plurality of stirring claws are fixedly disposed on the rotary shaft of the stirrer in a detachable manner.

10. The refrigerator according to claim 1, wherein the ice knife assembly further comprises:

at least one fixed ice knife, wherein the at least one fixed ice knife is configured to be fixed relative to the ice storage container;

at least one ice cube separator, wherein the at least one ice cube separator and the at least one fixed ice knife are located at two sides of the rotary shaft of the ice knife assembly separately, and the at least one ice cube separator is configured to be fixed relative to the ice storage container;

at least one movable ice knife, wherein the at least one movable ice knife is configured to be rotatable with the rotary shaft of the ice knife assembly;

wherein, the rotary shaft of the ice knife assembly is configured to drive the at least one movable ice knife to rotate in a first direction to break the ice cubes in the ice storage container under the cooperation of the at least one movable ice knife and the at least one fixed ice knife, and to drive the at least one movable ice knife to rotate in a second direction opposite to the first direction to separate the frozen ice cubes in the ice storage container under the cooperation of the at least one movable ice knife and the at least one ice cube separator.

11. A refrigerator, comprising:

a refrigerator door; and an ice maker, wherein the ice maker comprises:

an ice storage container disposed on the refrigerator door;

a stirrer provided in the ice storage container, wherein the stirrer comprises a rotary shaft and a plurality of stirring claws; the rotary shaft of the stirrer is in a first fixed position relative to the ice storage container; the plurality of stirring claws are provided on the rotary shaft of the stirrer; the plurality of stirring claws each has a longitudinal direction which is perpendicular to the rotary shaft of the stirrer; and the plurality of stirring claws are uniformly distributed in a circumferential direction of the rotary shaft of the stirrer, such that longitudinal directions of the plurality of stirring claws are spaced from each other with a same angular interval; and an ice knife assembly provided in the ice storage container, wherein the ice knife assembly comprises a rotary shaft and the rotary shaft of the ice knife assembly is in a second fixed position relative to the ice storage container, wherein the rotary shaft of the stirrer is located above the rotary shaft of the ice knife assembly, an orthographic projection of the rotary shaft of the stirrer in a horizontal plane and an orthographic projection of the rotary shaft of the ice knife assembly in the same horizontal plane are intersecting, wherein the ice maker further includes:

a driving device, the driving device being connected to the rotary shaft of the ice knife assembly; and a transmission assembly, an input end of the transmission assembly being connected to the rotary shaft of the ice knife assembly, and an output end of the transmission assembly being connected to the rotary shaft of the stirrer, so that the rotation of the rotary shaft of the ice knife assembly can drive the rotary shaft of the stirrer to rotate, wherein the transmission assembly includes:

a first intermediate shaft parallel to the rotary shaft of the ice knife assembly;

a second intermediate shaft parallel to the first intermediate shaft;

a first cylindrical gear set, wherein the rotary shaft of the ice knife assembly is connected with the first intermediate shaft through the first cylindrical gear set in a transmission manner; the first cylindrical gear set includes a first cylindrical gear and a second cylindrical gear; the first cylindrical gear is fixedly disposed on the rotary shaft of the ice knife assembly; and the second cylindrical gear is fixedly disposed on the first intermediate shaft, and engages with the first cylindrical gear;

a second cylindrical gear set, wherein the first intermediate shaft is connected with the second intermediate shaft through the second cylindrical gear set in a transmission manner; the second cylindrical gear set includes the second cylindrical gear and a third cylindrical gear; and the third cylindrical gear is fixedly disposed on the second intermediate shaft, and engages with the second cylindrical gear; and a bevel gear set, wherein the rotary shaft of the stirrer is connected with the second intermediate shaft through the bevel gear set in a transmission manner; the bevel gear set includes a first bevel gear and a second bevel gear; the first bevel gear fixedly is disposed on the second intermediate shaft; and the second bevel gear is fixedly disposed on the rotary shaft of the stirrer, and engages with the first bevel gear.

* * * * *